US005392987A

United States Patent [19]

Ropers et al.

[11] Patent Number: 5,392,987

[45] Date of Patent: Feb. 28, 1995

[54] MODULAR MODEL RAILROAD TRACK SUPPORT SYSTEM WITH SNAP-FIT CONNECTIONS

[76] Inventors: Jan W. Ropers, 1663 Marisma Way; Victor E. Chang, 703 Genter St., both of La Jolla, Calif. 92037

[21] Appl. No.: 144,810

[22] Filed: Oct. 28, 1993

[51] Int. Cl.[6] ..... E01B 23/00

[52] U.S. Cl. ..... 238/10 E; 104/111

[58] Field of Search ..... 238/10 R, 10 E, 10 F, 238/29, 30, 40, 41, 83, 84, 151, 179; 104/111, DIG. 1

[56] References Cited

U.S. PATENT DOCUMENTS

| | | | |
|---|---|---|---|
| D. 325,758 | 4/1991 | Black | D21/143 |
| 1,322,309 | 11/1919 | Klinzing | 104/111 |
| 1,564,337 | 12/1925 | Fischbach | 238/10 E |
| 2,974,608 | 3/1961 | Grube | 104/95 |
| 3,074,647 | 1/1963 | Bonanno | 238/10 |
| 3,734,404 | 5/1973 | Baynes et al. | 238/10 E |
| 3,837,609 | 9/1974 | Weiss et al. | 104/111 |
| 4,148,152 | 4/1979 | Barlow et al. | 238/10 R X |
| 4,181,995 | 1/1980 | Zur | 104/126 |
| 4,208,969 | 6/1980 | Baltensperger et al. | 104/111 |
| 4,319,425 | 3/1982 | Shine | 238/10 E |
| 4,726,515 | 2/1988 | Bolli et al. | 238/10 R X |
| 4,767,053 | 8/1988 | Cook et al. | 238/10 R |
| 4,955,537 | 9/1990 | Bratovz | 238/10 E X |
| 5,027,712 | 7/1991 | Wallick | 104/94 |
| 5,299,735 | 4/1994 | Thomas | 238/10 E X |

OTHER PUBLICATIONS

"Overhead Railways" brochure; Black, Joe; 4 pages.

*Primary Examiner*—Robert J. Oberleitner
*Assistant Examiner*—S. Joseph Morano
*Attorney, Agent, or Firm*—Brown, Martin, Haller & McClain

[57] ABSTRACT

A modular model railway support system is designed either for overhead installation or above ground support of conventional model railway tracks. The system includes a plurality of side rail members and cross ties having opposite ends designed for interlocking, snap engagement with the side rail members to secure two parallel lengths of successive side rail members together to form a selected pathway for supporting track with side rail members extending along opposite sides of a single or double track and the cross ties forming supports for the track. The side rail members on each side of the track are secured together end-to-end by the cross ties.

13 Claims, 3 Drawing Sheets

MODULAR MODEL RAILROAD TRACK SUPPORT SYSTEM WITH SNAP-FIT CONNECTIONS

BACKGROUND OF THE INVENTION

The present invention relates generally to model railroad support systems for supporting model railroad tracks either suspended from a ceiling or above a ground surface.

Model railroads are sometimes installed on overhead support systems so that they can be left permanently on display without taking up any needed floor space. Such systems must typically be custom designed, built and fitted for each individual installation, and are therefore expensive. One known overhead railroad support system has spaced parallel side members interconnected via crossbars on which a model railroad track is supported.

SUMMARY OF THE INVENTION

It is an object of the present invention to provide a new and improved support system for a model railroad track.

According to the present invention, a modular model railroad track support system is provided, which comprises a plurality of elongate side rail members including straight rail members and curved rail members having a range of different curvatures corresponding to the curvatures of standard model railroad tracks, and a plurality of cross ties for securing selected side rail members together to form a model railroad track support following any selected path and having at least two spaced parallel side guards extending along the path and a series of spaced cross ties extending between the side guards at spaced intervals along the path, each side guard comprising a plurality of side rail members secured together end-to-end by the cross ties, and each cross tie having a first mating formation at each end and each side rail member having a second mating formation at its opposite ends for mating engagement with the mating formation at one end of a cross tie to secure the rail members and cross ties together in a selected track support path.

Preferably, the mating formations are designed for snap locking engagement with one another, and may comprise corresponding dovetail plug and socket formations, with the formation at each end of the cross tie being designed to receive the mating formations at the ends of two abutting side rail members arranged end-to-end. Locking pins may be provided to secure the cross tie to the side rail members when the mating formations have been interlocked, for added security. This arrangement allows an individual to build a track support of any desired path from the same basic kit of parts and without needing any special tools.

The side rail members and cross ties are preferably designed to be moldable, and are preferably formed from molded plastic material or the like. In a preferred embodiment of the invention, two different types of cross tie are provided, a single cross tie for forming a single railroad track support and a double cross tie for forming a dual track support. The dual track support preferably comprises two spaced side guards and spaced double cross ties for supporting two model railroad tracks extending side-by-side along a selected path. The double cross tie has mating formations at its outer ends for connection to side rail members forming the spaced outer side guards for two side-by-side tracks supported on the cross ties, and also has mating formations intermediate the outer ends for mating engagement with the ends of inner side rail members at a junction between one or more single tracks and a double track. Suitable hangers are provided for suspending the system from a ceiling or supporting it above the ground or above other flat surfaces.

This system enables mass production at relatively low cost of all of the components needed to build a model railway support system following any desired path. The purchaser can easily install the support system without the expense of a custom-built and custom-installed system.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
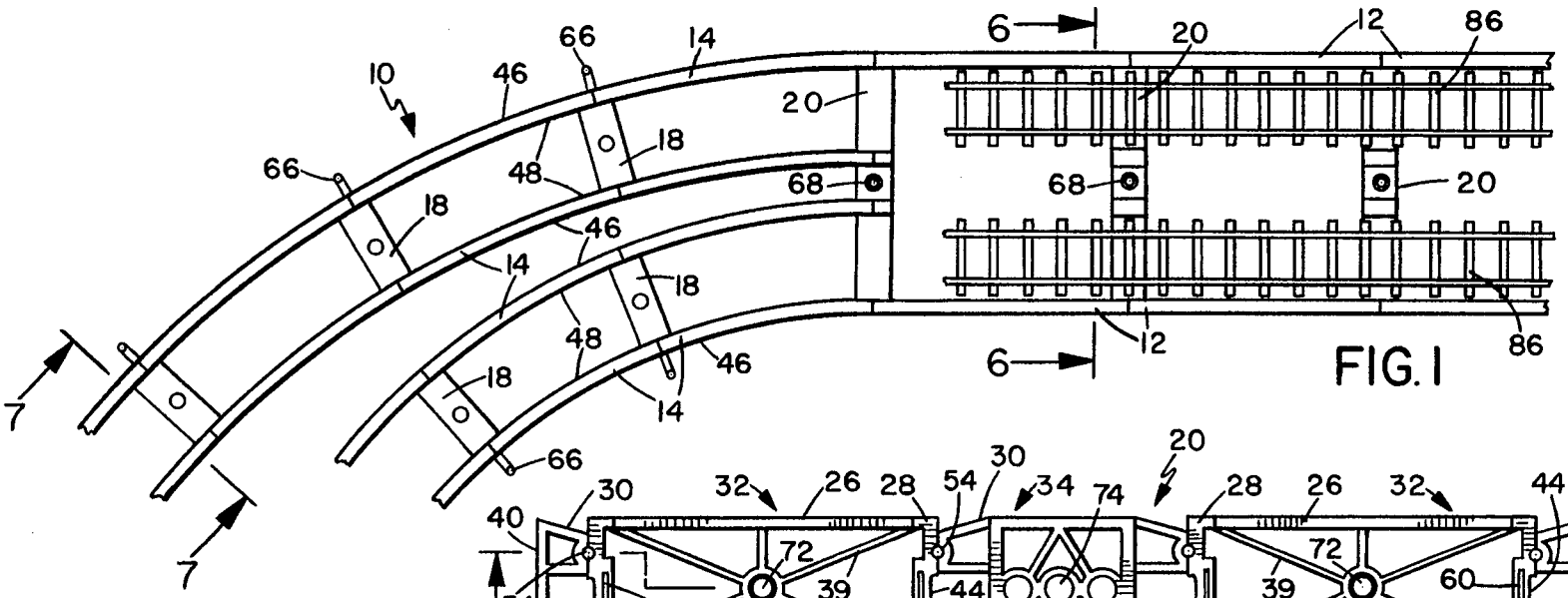
FIG. 1 is a top plan view of a portion of one possible track support layout using a track support system according to a preferred embodiment of the invention.
Figure 4:
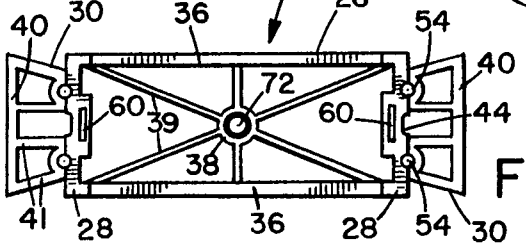
FIG. 4 is a top plan view of a single cross tie of the system.
Figure 5:
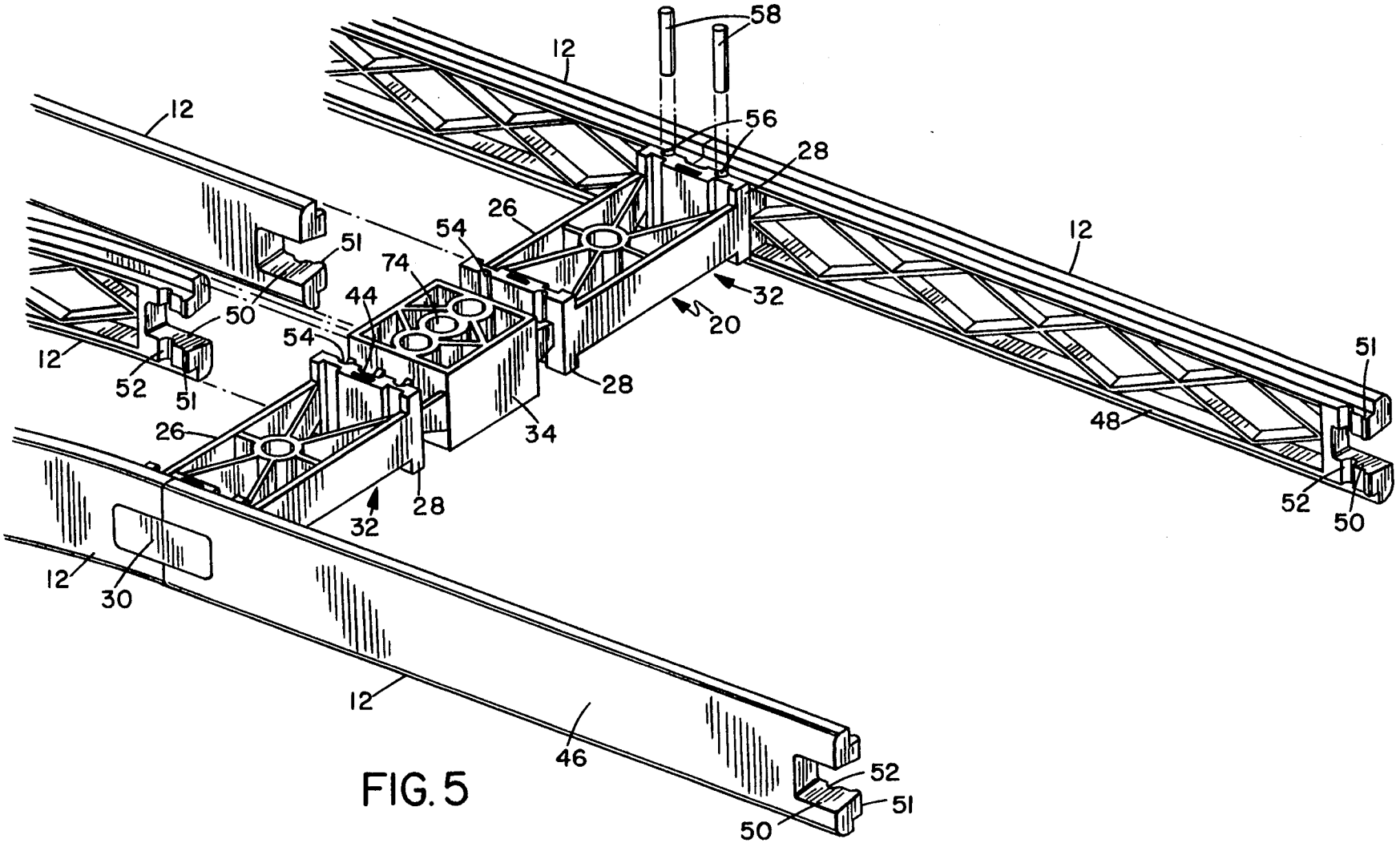
FIG. 5 is a perspective view of a partially assembled double track support section.
Figure 6:
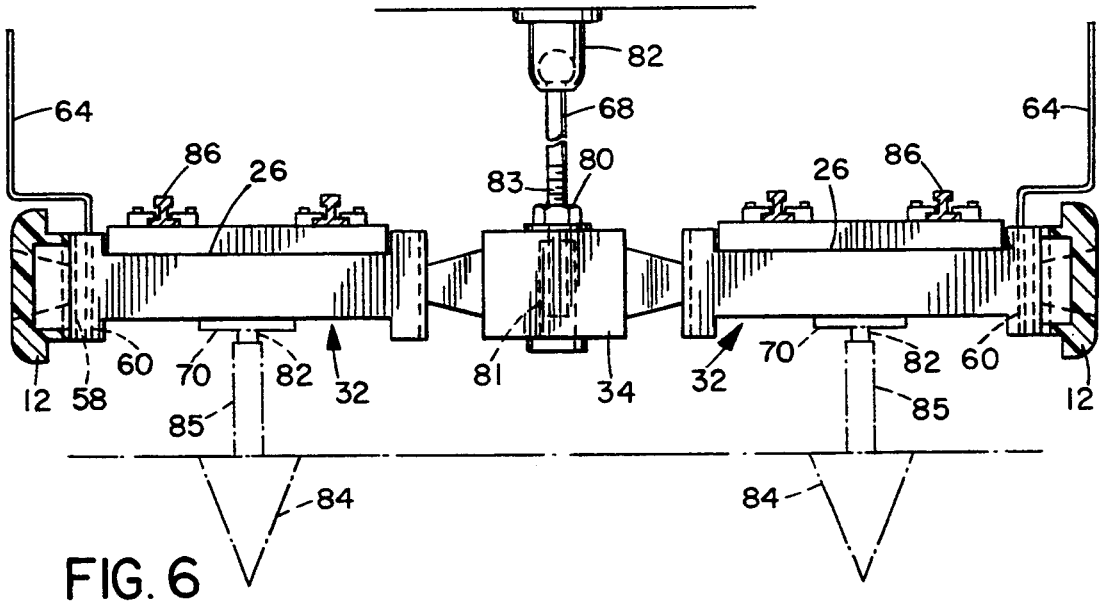
FIG. 6 is an enlarged sectional view taken on line 6—6 of FIG. 1.
Figure 9:
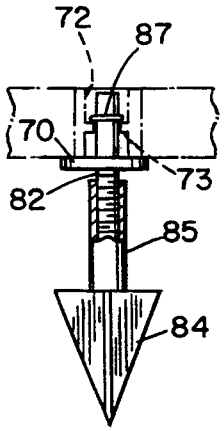
FIG. 9 is a side elevation view, partially sectioned, of a ground spike for supporting the track support layout.
Figure 7:
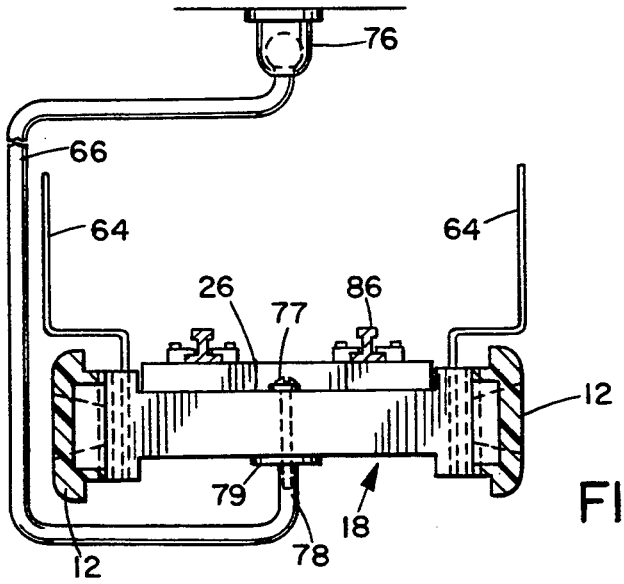
FIG. 7 is an enlarged sectional view taken on line 7—7 of FIG. 1.

FIGS. 1–5 and 8 illustrate a support system 10 for supporting a standard model railway, for example a standard LGB G-gauge track 86, as illustrated in FIGS. 1, 6 and 7. The track may be either suspended from the ceiling in an overhead installation or supported above a flat surface such as the ground. The support system basically comprises a number of modular, snap-engaging parts, including a number of different elongate side rail members including straight side rail members 12 of different length, and curved side rail members 14 of different lengths and curvatures, as well as a single cross tie 18 and a double cross tie 20 for securing the side rail members together in a selected manner. The system also includes hangers 66,68 for suspending the connected cross ties and side rail members from an overhead support, and ground spikes for selectively supporting the arrangement above the ground, as illustrated in FIGS. 6, 7 and 9.

It will be understood that the curved side rail members will be provided in curvatures matching that of the standard model railway to be supported. The curved side rail members will be provided with both convex and concave curvatures for extending along the outer and inner sides of curved track. In one embodiment of the invention, curved inner and outer side rail members were provided to match the curvatures of standard 1500 and 1100 G-gauge track. Additionally, straight and curved side rail members may be provided in two or more different lengths. This has been found to allow various different G-gauge track layouts to be supported. However, it will be understood that side rail members of different lengths and curvatures may be provided if necessary for different types of installation.

Figure 2:
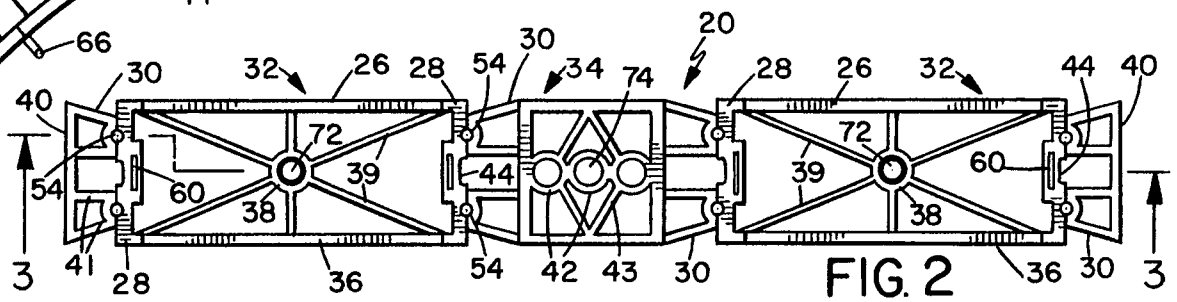
FIG. 2 is an enlarged top plan view of a double cross tie of the system.
Figure 3:
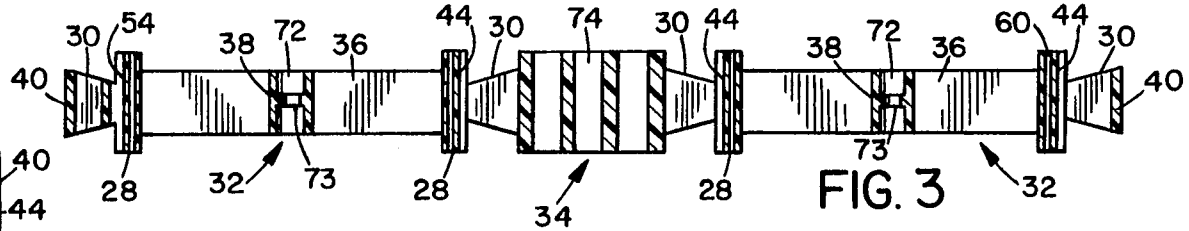
FIG. 3 is a sectional view taken on line 3—3 of FIG. 2.

The single cross tie 18 is illustrated in detail in FIG. 4, while the double cross tie 20 is illustrated in FIGS. 2 and 3. The double cross tie 20 has end portions 32 which are each of identical shape to that of a single cross tie, and which are secured together by central box-shaped portion 34. Each single cross tie 18 and each end portion 32 of the double cross tie is generally I-shaped in cross-section and has a central flat, rectangular portion 26 for supporting part of a model railway and opposite end walls 28 which have a height greater than that of portion 26 and from which dovetail plugs 30 project. The width of portion 26 will be designed to substantially match that of the track 86 to be supported, as best illustrated in FIGS. 6 and 7.

The shape of each end portion 32 of the double cross tie is substantially identical to that of the single cross tie 18, so that double cross tie 20 is equivalent to two single cross ties secured together by central reinforcing portion 34. Each of the cross ties is of an open framework type of formation of interconnected webs designed to be mold-releasable so that the cross ties can be molded from a suitable plastic material in a relatively inexpensive mass production process. The same die can be used for the double and single cross ties, further reducing expense. The open framework structure of the cross ties provides sufficient strength for track support while minimizing material requirements.

In the illustrated embodiment, each single cross tie 18 and each end portion 32 of the double cross ties 20 has spaced side walls 36 and a central ring 38 interconnected by cross webs 39 to form support surface 26. Central ring 38 forms a center opening or bore 72 for attachment to a suitable ceiling or ground support. Bore 72 has an annular rib 73 intermediate its ends, defining a reduced diameter portion of the bore. Each dovetail plug 30 is also of open plan construction and has an outer end wall 40 secured to end wall 28 via spaced, parallel dovetail webs 41. The central portion 34 of each double cross tie has an open-ended square box periphery with three adjoining center rings 42 and cross webs 43 inside the periphery. The central three rings 42 each define a through bore 74 for selective attachment to a ceiling hanger. With this arrangement, the cross ties can be made using upper and lower die halves and can be released by detaching the mold halves upwardly and downwardly. The wall thickness of the side and end walls and cross webs of each cross tie is kept to a minimum thickness of around ⅛-inch.

Figure 8:
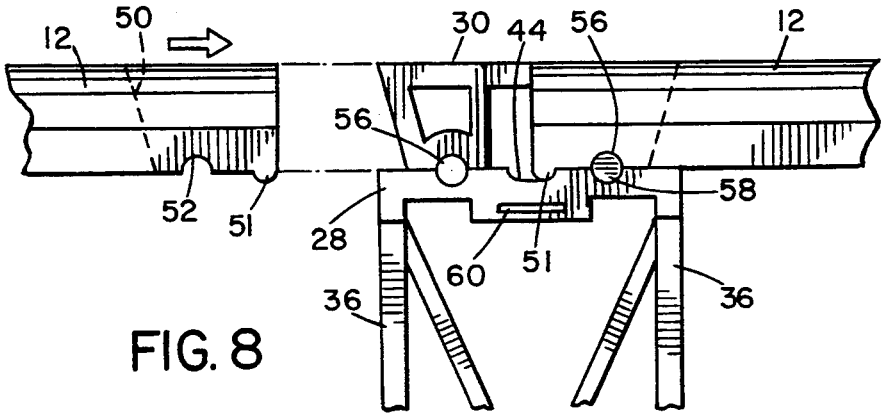
FIG. 8 is an enlarged top plan view of a typical cross tie and side rail connection.

As best illustrated in FIGS. 1 and 5, the straight and curved side rail members 12, 14 each have an outer flat face 46 and inner face 48, and a dovetail socket 50 at each end for snap engagement approximately halfway over a dovetail plug 30 of a single or double cross tie. In other words, the depth of each socket 50 is equal to half the transverse width of plug 30. Thus, the sockets 50 of two side rail members may be engaged in opposite directions over a single plug 30 so as to secure the side rail members together end to end, as best illustrated in FIGS. 5 and 8. As best illustrated in FIG. 8, each of the side rail members 12,14 has a rounded rib or lip 51 on its inner face projecting outwardly and extending across the outer end of the socket 50 at each end of the side rail member. The end walls 28 of each cross tie and cross tie end section have corresponding notches 44 which have a width equal to twice that of one of the lips 51, and into which the lips will snap when the sockets of two opposing side rail members are engaged over the dovetail plugs, as illustrated in FIG. 8. When two side rail members are fully engaged over a plug 30, their end edges will be in face-to-face engagement, forming a smooth transition from one side rail member to the next, as illustrated in FIGS. 1 and 5.

A vertical notch 52 of generally semi-cylindrical shape is also provided on the inner face 48 at each end of the side rail member so as to extend across the dovetail socket, as best illustrated in FIGS. 5 and 8. Each of the end walls 28 of the double and single cross ties has a pair of vertical notches 54 extending across it and through the dovetail plug or formation for cooperation with the notches 52 on the ends of side rail members engaging over the dovetail plug or formation at that end wall of the cross tie, as best illustrated in FIGS. 5 and 8. Notches 54 are semi-cylindrical in shape on the end wall above and below plug 30, and form a cylindrical bore through the plug 30 itself, as illustrated in FIGS. 2 and 4. Thus, when two opposing dovetail sockets 50 are engaged over a single plug 30 as illustrated in FIGS. 5 and 8, continuous bores 56 will be formed from the top to the bottom of end wall 28. As illustrated in FIGS. 5 and 8, locking pins 58 are inserted through the resultant bores 56 when the dovetail sockets are engaged over the dovetail plugs or formations, so as to hold the parts together. Slots 60 are also provided on each of the end walls of each cross tie for receiving rail guard pins 64.

Since the dovetail plugs flare outwardly from end walls 28, and each dovetail socket has a corresponding flare from the inner to the outer face of the respective side rail member, the side rail members can be engaged over the dovetail sockets only in a direction transverse to the longitudinal axis of cross tie 18 or 20. Thus, once locking pins 58 are inserted, the side rail members are effectively locked onto the cross ties and cannot be removed without first removing pins 58.

The side rail members 12,14 are preferably also molded from a suitable plastic material. The inner faces 48 of the side rail members have grooves reinforced by cross-webs of open lattice-style construction to reduce material requirements while providing the necessary structural strength and rigidity. Although the inner faces 48 of only the straight side rail members can be seen in FIG. 5, it will be understood that the convex and concave inner faces 48 of the curved side rail members will be of equivalent lattice-style construction, and that the shape of the ends of each side rail member 12,14 will be identical to that illustrated in FIG. 5.

FIG. 1 illustrates one possible arrangement of the support system in part of an overhead installation for supporting standard model railway track 86. The side rail members can be secured together by the cross ties so as to follow any selected path for a model railroad, and FIG. 1 is only one example of such a path in part of a possible arrangement. In order to form single track sections as illustrated to the left of FIG. 1, side rail members 12 or 14 are secured together in pairs using the single cross ties 18. A first pair of rail members is snap engaged at one end in a first direction over the end plugs at opposite ends of a cross tie 18, and the subsequent pair of side rail members in the selected track path is snap engaged over the end plugs in the opposite direction to the first pair so that the ends of the rail members are in abutment to form a smooth transition from one side rail member to the next, as illustrated in FIGS. 1 and 8. The snap engagement between the dovetail plugs and sockets is sufficient to retain the parts together during assembly, but locking pins 58 must be inserted in the resultant bores 56 formed by the aligned notches 52,54 in the side rail members and cross tie end walls in order to lock the parts securely together once assembled. This procedure is repeated until the desired single track path section has been formed.

A double track support section is formed by engaging a pair of side rail members with the dovetail plugs at the outer ends of a double cross tie, as indicated on the right hand side of FIG. 1 and in FIG. 5. Two side rail members are secured over the dovetail plugs 30 at the outer ends of a double cross tie in a first direction, and two side rail members are snap engaged in the opposite direction over the outer plugs 30 into abutment with the ends of the first two side rail members, as illustrated on the right-hand side of FIG. 5. Locking pins 58 are inserted into the resultant bores 56 at each end wall 28. This procedure is repeated along the desired pathway of the double track. A double cross tie is also used at the junction between one or two single track sections and a double track section, as illustrated in FIGS. 1 and 5. In this case, the pair of side rail members at the end of the or each single track section will engage over the plugs 30 at opposite ends of the or each end portion 32 of the double cross tie at the junction, as best illustrated in FIG. 5. Once assembly is completed, a continuous support for track 86 along the flat portion or portions 26 and 36 of the single and double cross ties is formed, with spaced side guards along opposite sides of the single track and on the outer sides of the double track formed by the side rail members 12,14. This allows essentially any desired track configuration to be supported using the same basic modular parts, without the need for custom made and installed support systems.

Once the support system has been constructed by snapping together selected parts to form the desired track layout or section of track layout, the resultant assembly is suspended from the ceiling using hangers 66,68 at spaced intervals, or supported above the ground via ground supports 70, as illustrated in FIGS. 6, 7 and 9. Hangers 66 are designed for suspending a single cross tie from an overhead support and hangers 68 are designed for suspending a double cross tie from an overhead support, as illustrated in FIGS. 6 and 7. Also provided are ground supports 70 for selectively supporting a track above the ground in an outdoor installation, for example, as illustrated in dotted outline in FIG. 6 and in FIG. 9. The central bore or opening 72 of each single cross tie is designed for selectively receiving a hanger or ceiling support 66, as illustrated in FIG. 7, or a ground support 70. Similarly, the bore or opening 74 in central portion 34 of each double cross tie is designed for receiving the double track ceiling support or hanger 68, as illustrated in FIG. 6. Additionally, bores 72 in the end portions 32 of each double cross tie may selectively receive ground supports 70, as illustrated in dotted outline in FIG. 6.

Hanger 66 is a generally C-shaped pin or rod member having a first end 76 designed for mounting on a ceiling or overhead support in a conventional manner, and a second end 78 projecting upwardly and having a threaded bore for receiving the end of a screw 77 extending downwardly through center opening 72 of a single cross tie, so that the hanger 66 projects outwardly and upwardly to one side of the track. Washers 79 are provided on end 78 and on screw 77, for clamping against opposing surfaces of portion 26 as the screw is tightened, to provide a secure connection.

Each of the hangers 68 is in two parts, comprising a straight pin or rod member having a head 82 for ceiling or overhead mounting, and a threaded shaft 83, and a headed ferrule 81 having a head at one end and a tubular shaft portion for extending through a selected opening 74 in a double cross tie. Shaft 83 extends downwardly into the bore in member 81, and the parts are secured in the opening via lock nut 80. Hanger 68 will engage the central opening 74 of any double cross tie securing two straight side rail members together at a straight double track support section. Where the cross tie is used to secure curved side rail members together and forms a support for a pair of curved tracks, it may engage the outermost opening 74 to ensure that the hanger 68 remains clear of carriages on the tracks as they tilt when making the turn.

The ground spike or support 70 may be engaged in the center opening 72 of a single cross tie or in each of the center openings in opposite end portions of a double cross tie, as illustrated in FIGS. 6 and 9. Each ground support has a pointed, conical end portion 84 for engagement in the ground, and an upstanding pin 85 threadably engaged in conical portion 84 for height adjustment purposes, and having an end portion 82 for extending through a center opening 72 in either type of cross tie. Annular rib 87 on end portion 82 snaps over rib 73 in bore 72 to secure the cross tie to pin 85. The pin will have a suitable screwdriver slit at its upper end for adjustment of the height of an attached track support section above the ground.

Once a series of side rail members 12,14 have been secured together via cross ties 18,20 and locking pins 58 to follow a predetermined path, standard model train track 86 can be laid across the flat, track support portions 26 of each single and double cross tie so as to extend between the side rails, as illustrated in FIGS. 1, 6 and 7. Guard pins 60 are designed to prevent trains from accidentally falling from track 86, and each have a first straight end portion 88 for insertion in a selected slot 58, bent perpendicular portion 89, and second end portion 90 projecting parallel to end portion 88 but spaced outwardly from it to act as a guard.

For additional security against cars accidentally becoming dislodged and falling from the track, guard pins 64 are installed at spaced intervals in the notches 60 provided for that purpose in the end walls of the cross ties on opposite sides of each track supporting portion of the cross ties.

In this system, a modular railroad support can be built readily from a small number of modular parts, with no special or customized manufacture or installation required. The modular parts are all designed to be molded from relatively inexpensive plastics material. The parts are also designed to be snap locked together in a quick and convenient manner, with locking pins for additional security once the desired track layout has been achieved. The side rail members come in a range of straight lengths and curvatures to permit parallel straight and curved single and double track support to be provided. The system is versatile enough to allow a large number of different track layouts to be supported using the same basic component parts. The side rails and cross ties are all designed to be mold-releasable for inexpensive manufacture. This system allows overhead and above ground support installations to be built much more easily and at considerably reduced expense as compared with conventional custom-built installations.

Although a preferred embodiment of the present invention has been described above by way of example only, it will be understood by those skilled in the field that modifications may be made to the disclosed embodiment without departing from the scope of the invention, which is defined by the appended claims.

We claim:

1. A modular model railroad track support assembly, comprising:

a plurality of elongate side rail members having opposite ends, the side rail members including straight rail members and curved rail members having a range of different curvatures;

a plurality of cross ties for selectively securing the side rail members together to form a model railroad track support following a selected path, the track support having at least two spaced parallel side rails extending along the path and a series of said cross ties extending between the side rails at spaced intervals along the track support to support at least one model railroad track on the cross ties between the spaced side rails, each side rail comprising a plurality of said side rail members secured together end-to-end by the cross ties;

each said cross tie having opposite ends and a first mating formation at each end of the cross tie;

each said side rail member having opposite ends and a second mating formation at each end of the side rail member for releasable mating engagement with the first mating formation at the corresponding ends of respective ones of said cross ties to secure the cross ties and side rail members together in said selected path.

2. The assembly as claimed in claim 1, wherein said mating formations include snap-engaging means for releasable snap engagement between said first and second mating formations.

3. The assembly as claimed in claim 1, wherein the first mating formations comprise dovetail plugs projecting from opposite ends of each cross tie, and the second mating formations comprise dovetail sockets at each end of each side rail member for snap engagement over the plugs.

4. The assembly as claimed in claim 3, wherein each dovetail plug has a transverse width equal to twice the depth of each dovetail socket, and comprises means for receiving two dovetail said sockets at the abutting ends of two side said rail members engaged in opposite directions over the dovetail plug.

5. The assembly as claimed in claim 3, wherein each dovetail plug flares outwardly from the respective end of a respective cross tie, each side rail member has an inner face and an outer face, and each dovetail socket flares outwardly from the inner face to the outer face of the side rail member.

6. The assembly as claimed in claim 1, including additional locking means for locking the side rail members and cross ties together.

7. The assembly as claimed in claim 6, wherein the side rail members and cross ties have cooperating notches which form a bore extending through said mating formations when a side rail and cross tie are secured together, and said locking means comprise pins for insertion through said bores to lock the side rail members and cross ties together.

8. The assembly as claimed in claim 1, wherein the cross ties and side rail members are of molded plastic material.

9. The assembly as claimed in claim 8, wherein each cross tie is of open framework construction comprising a plurality of interconnected webs with openings between the webs.

10. The assembly as claimed in claim 1, wherein two different types of cross tie are provided, comprising a single cross tie for forming a single railroad track support, and a double cross tie for forming a support for two parallel railroad tracks, each single cross tie having a central, track support portion and opposite ends each having a first mating formation, and each double cross tie having two spaced end portions and a central portion securing the end portions together, each end portion having a track support portion, and opposite ends of each end portion each having a first said mating formation.

11. The assembly as claimed in claim 10, wherein the single cross tie is of generally I-shaped cross-section and said spaced end portions of the double cross tie are each generally I-shaped.

12. The assembly as claimed in claim 10, wherein the single cross tie and each end portion of the double cross tie are of identical shape and dimensions.

13. The assembly as claimed in claim 1, further including a plurality of guard pins for installation at spaced intervals on opposite sides of said model railroad track support, the cross ties having slots on opposite sides for receiving said guard pins so that said guard pins project upwardly on opposite sides of a said model railroad track supported on said model railroad track support.

* * * * *

UNITED STATES PATENT AND TRADEMARK OFFICE

CERTIFICATE OF CORRECTION

PATENT NO. : 5,392,987

DATED : February 28, 1995

INVENTOR(S) : Jan W. Ropers and Victor E. Chang

It is certified that error appears in the above-indentified patent and that said Letters Patent is hereby corrected as shown below:

- COLUMN 7, CLAIM 4, LINE 53, BEFORE "DOVETAIL" INSERT --SAID--; AFTER "DOVETAIL" DELETE "SAID";
- COLUMN 8, CLAIM 4, LINE 1, BEFORE "SIDE" INSERT --SAID--; AFTER "SIDE" DELETE "SAID".

Signed and Sealed this

Second Day of May, 1995

*Attest:*

Bruce Lehman

BRUCE LEHMAN

*Attesting Officer*

*Commissioner of Patents and Trademarks*